US007069701B2

(12) United States Patent
Chen

(10) Patent No.: US 7,069,701 B2
(45) Date of Patent: Jul. 4, 2006

(54) GROUNDWORK FRAME STRUCTURE

(76) Inventor: Yueh-Chu Chen, No. 72-17, Tianliao, Yanshuei Township, Tainan County (TW)

( * ) Notice: Subject to any disclaimer, the term of this patent is extended or adjusted under 35 U.S.C. 154(b) by 466 days.

(21) Appl. No.: 10/654,937

(22) Filed: Sep. 5, 2003

(65) Prior Publication Data

US 2005/0050819 A1 Mar. 10, 2005

(51) Int. Cl.
*E04C 3/00* (2006.01)

(52) U.S. Cl. ..... 52/580; 52/581; 52/588.1; 52/177; 52/79.3; 52/7; 52/604; 52/605

(58) Field of Classification Search ..... 52/7, 52/77, 79.3, 604–605, 641, 578, 298–299, 52/580, 36.4, 36.5, 36.1, 384, 390, 588.1, 52/589.1, 590.1, 590.2, 590.3, 591.1, 591.2, 52/591.3, 591.4, 591.5, 592.1, 592.2, 592.3, 52/592.4, 592.5, 592.6

See application file for complete search history.

(56) References Cited

U.S. PATENT DOCUMENTS 781,413 A * 1/1905 Fisher ..... 52/604
3,881,571 A * 5/1975 Moulton ..... 182/178.5
4,073,100 A * 2/1978 DiGiovanni, Jr. ..... 52/79.3
4,983,089 A * 1/1991 Rose ..... 414/276
5,062,242 A * 11/1991 Corcoran ..... 52/36.1
5,457,926 A * 10/1995 Jensen ..... 52/604
5,950,377 A * 9/1999 Yoder ..... 52/177
6,010,279 A * 1/2000 Taylor-Smith ..... 405/286
6,122,881 A * 9/2000 Aubertot ..... 52/604
6,324,796 B1 * 12/2001 Heath ..... 52/177
6,467,224 B1 * 10/2002 Bertolini ..... 52/177
6,477,814 B1 * 11/2002 Kadosh ..... 52/439
6,962,028 B1 * 11/2005 Banova ..... 52/592.5

* cited by examiner

*Primary Examiner*—Jeanette E. Chapman
(74) *Attorney, Agent, or Firm*—Birch, Stewart, Kolasch & Birch, LLP

(57) ABSTRACT

An improved groundwork frame comprises a protruded bar each disposed in the middle of the top of an upper board and a lower board; an embedding groove being disposed in the middle of the bottom of the groundwork frame and corresponsive to the protruded bar; an upper groove and a lower groove respectively disposed on both sides of each floor board to define an embedded assembly; an opening being disposed on each corresponding edge of adjacent boards; an elastic clamp for clipping and securing the groundwork frame, and each floor board having a chamber; a screw hole and an adjusting screw hole being disposed on both sides of the chamber, such that the lower board on the floor being sheathed in the latch and an adjusting screw rod for adjusting the floor to an appropriate height.

5 Claims, 7 Drawing Sheets

GROUNDWORK FRAME STRUCTURE

FIELD OF THE INVENTION

The present invention relates to an improved groundwork frame structure, more particular to a groundwork frame that overcomes the shortcomings of the conventional groundwork frame that can only be used for a certain specific height, and also provides a way of connecting adjacent boards at each level by embedding the board with each other, and thus making the connection quicker, and slightly adjusting the height by assembling the upper and lower boards.

BACKGROUND OF THE INVENTION

Conventional construction methods generally adopt wooden corners as the main construction material for the construction of groundwork, because wooden corners can be nailed by a hammer. As a result, it may cause a relatively high error in precision and also create problems to the construction when adjusting the precision. Furthermore, it is necessary to saw the wooden corners one by one, not only wasting working time, but also making the construction inefficient. Since the wooden corner is large and heavy, therefore it takes more time for its transportation, and thus increasing the cost accordingly. Furthermore, wooden corners are easily bitten by termites and moistened, which will cause deformations and damages to the floor.

SUMMARY OF THE INVENTION

The primary objective of the present invention is to connect every board by clipping an elastic clamp between the mutually embedded boards and making slight adjustments sideway on two adjacent boards depending on the deformation of the flexible distance between the floor caused by the contraction and expansion due to temperature change.

Another objective of this invention to save the cost of manufacturing mold by using the boards of the same shape for each layer, so that users can install any number of layers of boards according to the requirement of the actual site.

Another objective of this invention is to add a screw hole at the accommodating chamber on both sides of the bottom of the bottom board for any number of layers for inserting a wedge and an adjusting screw rod, such that the height of the stand can be adjusted to an appropriate height for different sites.

DETAILED DESCRIPTION OF THE PREFERRED EMBODIMENTS

Figure 1:
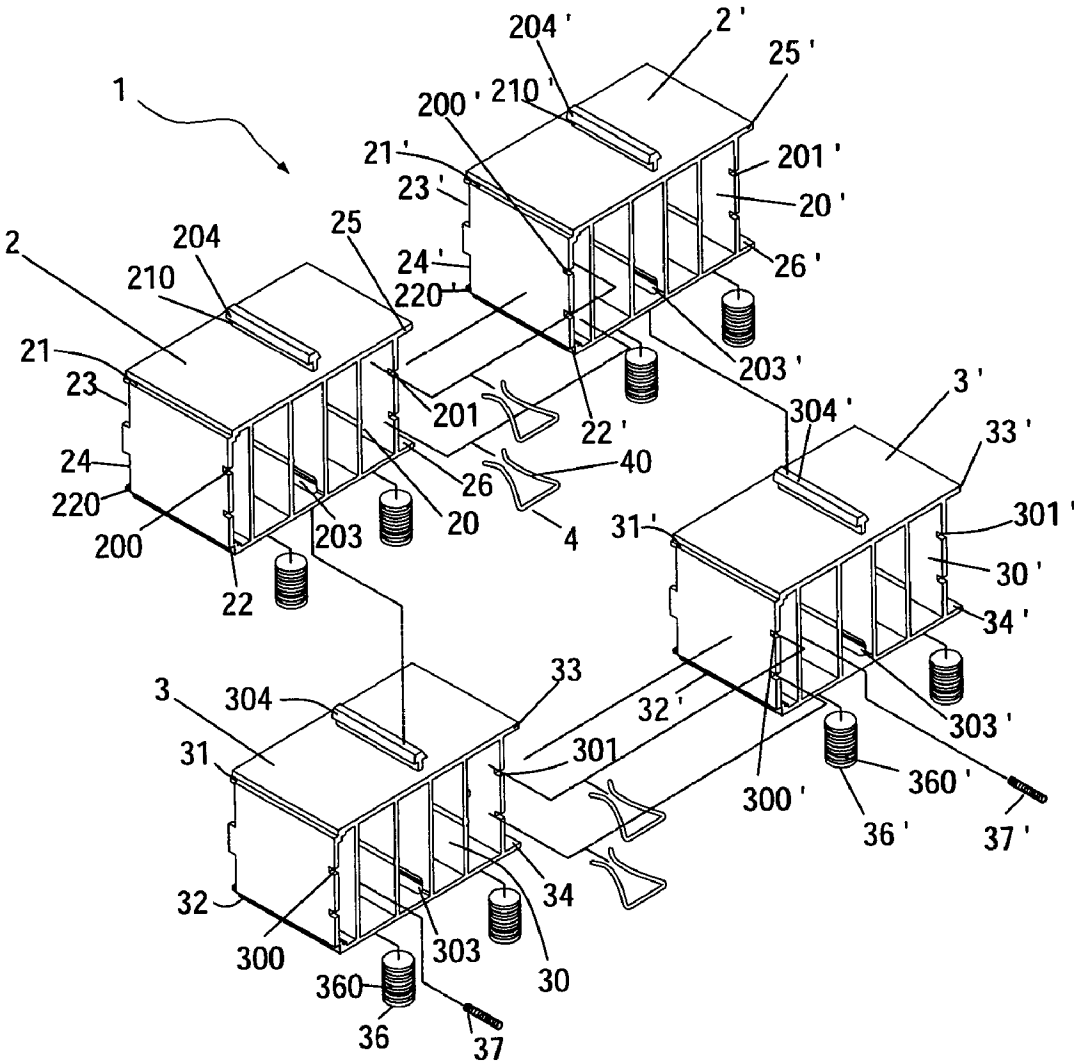
FIG. 1 is a perspective diagram of the disassembled parts of the structure of the present invention.
Figure 2:
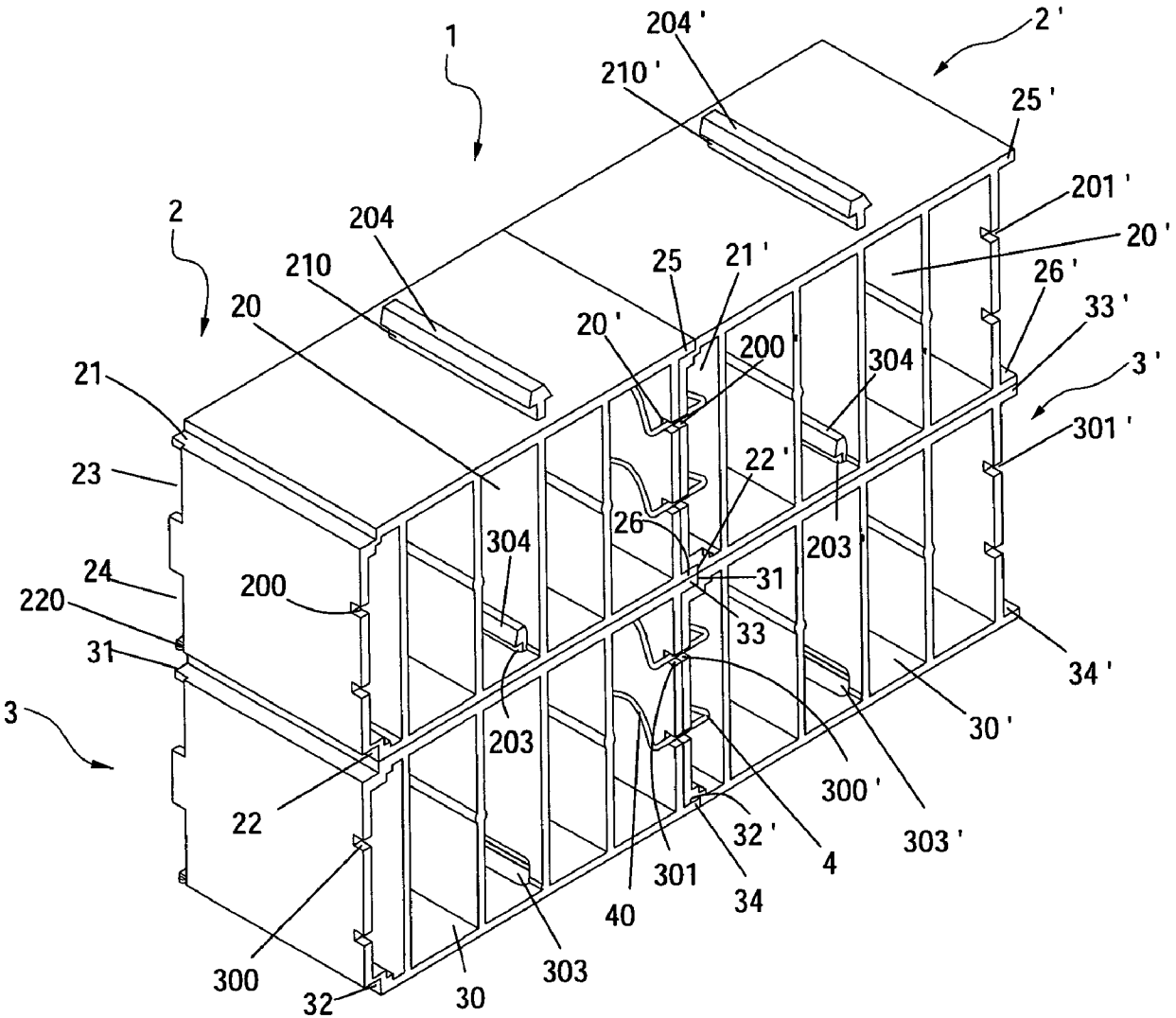
FIG. 2 is a perspective diagram of the present invention.

Please refer to FIGS. 1 and 2 for the improved groundwork frame structure, comprising an upper board 2, 2' and a lower board 3, 3' and an elastic clamp 4.

Figure 4:
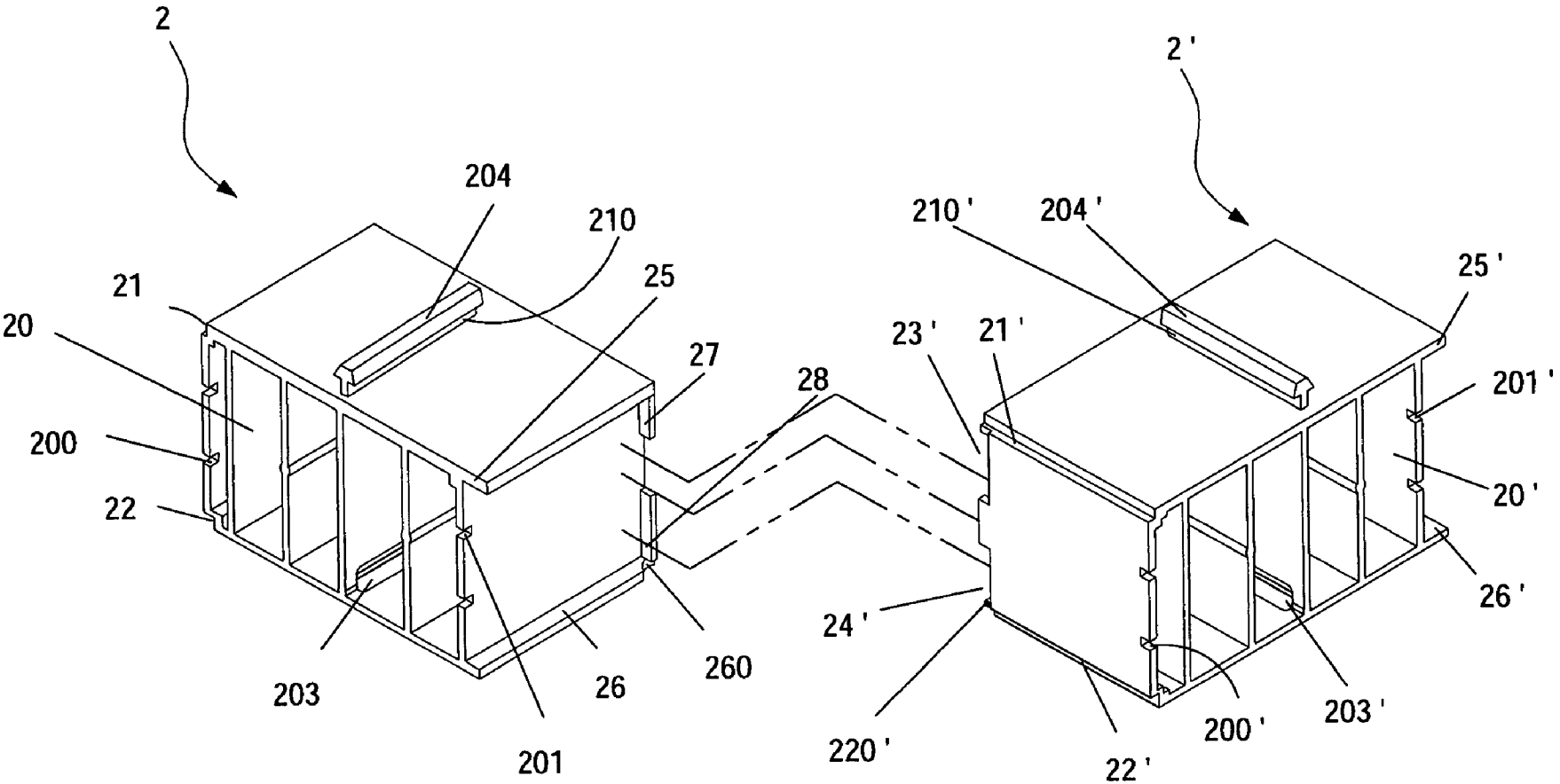
FIG. 4 is a perspective rear-view diagram of disassembled part of the structure of the present invention.

The upper board 2, 2' has a plurality of chambers 20, 20' therein, and an upper groove 21, 21' and a lower groove 22, 22' disposed on one side; a protruded bar 204, 204' having an embedding groove 210, 210' disposed on both sides of the middle of the top of the upper board 2, 2', an embedding groove 203, 203' disposed on the bottom of the upper board 2, 2' corresponding to the protruded bar 204, 204'; a blocking member 220, 220' disposed at the end of the lower groove 22, 22'; an opening 23, 24, 23', 24' disposed at the upper and lower indent at an end of the same side; an upper and lower protruded edge 25, 26, 25', 26' disposed on another side of the upper board 2, 2'; and a concave opening 260' 260' disposed at the end of the lower protruded edge 26, 26' (as shown in FIG. 4). A corresponding blocking panel 27, 28 is protruded from the upper and lower sections at the end on the other side, and such upper board 2, 2'at its bottom on both sides has a chamber 20, 20' with corresponsive screw holes 29. 29' and an adjusting screw hole 290, 290' on one side; an opening 200, 201, 200', 201' for latching the elastic clamp 4 on both sides of the upper board 2, 2'.

The lower board 3, 3' has a chamber 30, 30' in its interior, and an upper groove 31, 31' and a lower groove 32, 32' on one side, and an upper protruded edge 33, 33' and a lower protruded edge 34, 34' on the other side, and an opening 300, 301, 300' 301' of the upper board 2,2' corresponding to the opening 200,201,200' 201'.

The lower board 3, 3' at its top has a protruded bar 304, 304' for embedding into the embedding groove 203, 203' of the upper board 2, 2'; and the structure of the lower board 3, 3' (not numbered in the figure) is the same as that of the upper board 2, 2', and thus will not be described here.

Figure 3:
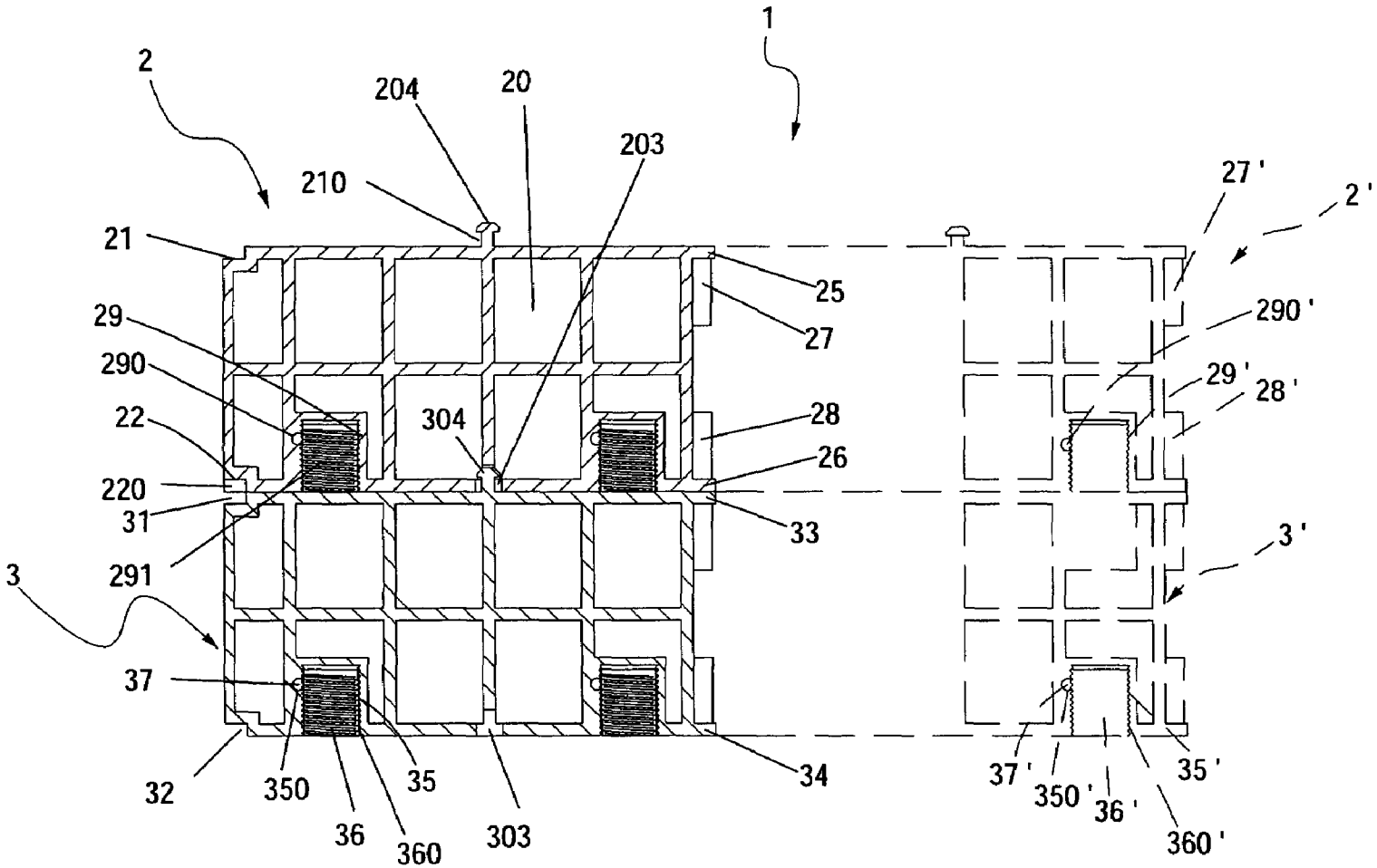
FIG. 3 is a planar diagram of the assembled upper and lower boards according to the present invention.

If the frame is assembled (as shown in FIG. 3), the upper and lower protruded edges 25, 26 on the other side of two adjacent upper boards 2, 2' are engaged into the upper and lower grooves 21', 22' and the concave opening 260 of the lower protruded edge and another side of two blocking panels 27, 28 are engaged with the blocking member 220' of the lower groove 22' and the corresponding opening 23' 24' on one side respectively (as shown in FIG. 4), and then the protruded bar 304, 304' of the lower boards 3, 3' are engaged with the embedding groove 203, 203' at the bottom of two upper boards 2, 2', and the corresponding opening 201, 200', 301, 300' on the adjacent sides of the upper and lower boards 2, 2', 3, 3' are secured by a clipping arc 40 of an elastic clamp 4, and such elastic clamp 4 can form a space with elasticity in contractible force, tension and deformation between the upper and lower boards 2, 2', 3, 3' to adapt for the expansion and contraction caused by temperature change.

Figure 5:
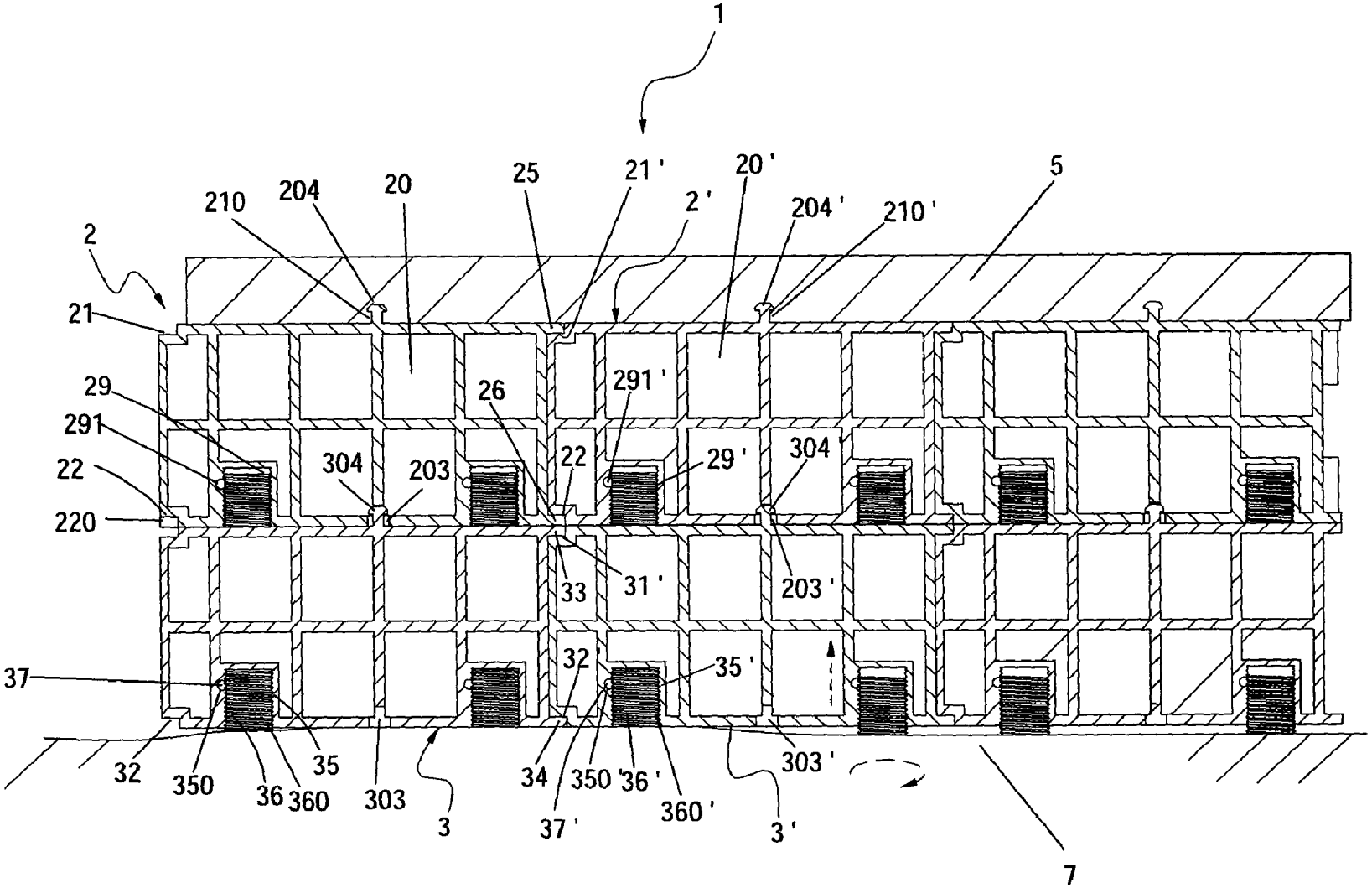
FIG. 5 is an illustrative diagram of adjusting the height of the stand from the floor according to the present invention.

Further, please refer to FIG. 5 for the present invention. After the lower boards 2, 2', 3, 3' of the frame 1 in accordance with this invention are installed at the position of the construction site, it can be adjusted according to the height of floor 7 or the uneven surface of the floor 7. The corresponding screw hole 35, 35' at the bottom of the lower board 3, 3' and the adjusting screw 350, 350' on the same side are used to fine tune the frame 1 from the uneven surface of the floor 7 by using a latch 36, 36' with outer screw thread 360, 360' and an adjusting screw rod 37, 37', such that the floor 7. The height of the floor 7 can be adjusted timely to obtain an overall level frame 1. Then, the embedding groove 210, 210' of the protruded bar 204, 204' at the top of the upper board 2, 2' are embedded with a board member 5'. When the protruded bar 204, 204' is engaged with the board member 5, the upper and lower boards 2, 2', 3, 3' are connected and fixed by the elastic clamp 4. Therefore, it is easy to embed the components due to the elasticity. At last, the board member 5 is nailed for the fixing.

Figure 6:
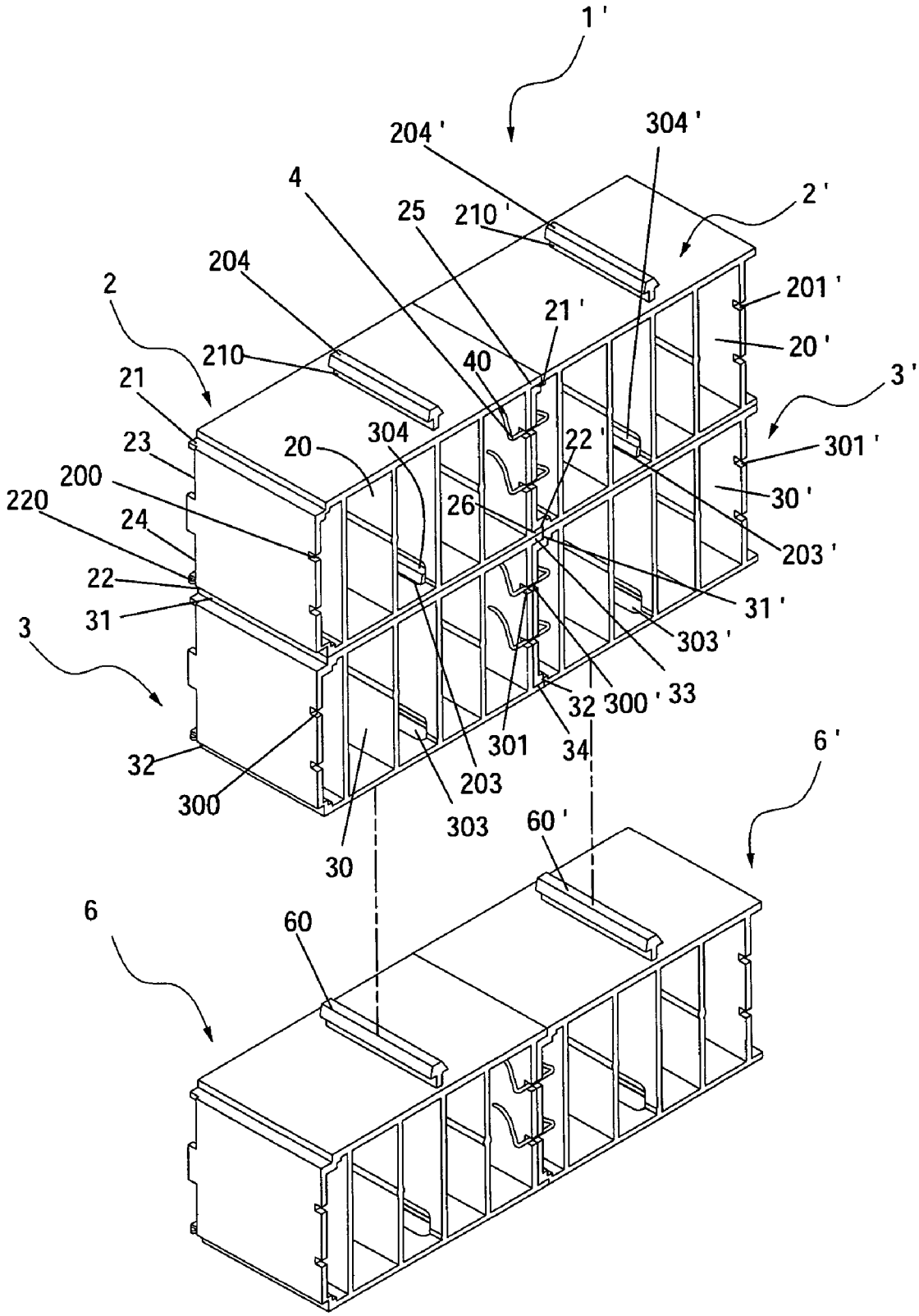
FIG. 6 is a perspective diagram of several sets of disassembled upper and lower boards according to the present invention.
Figure 7:
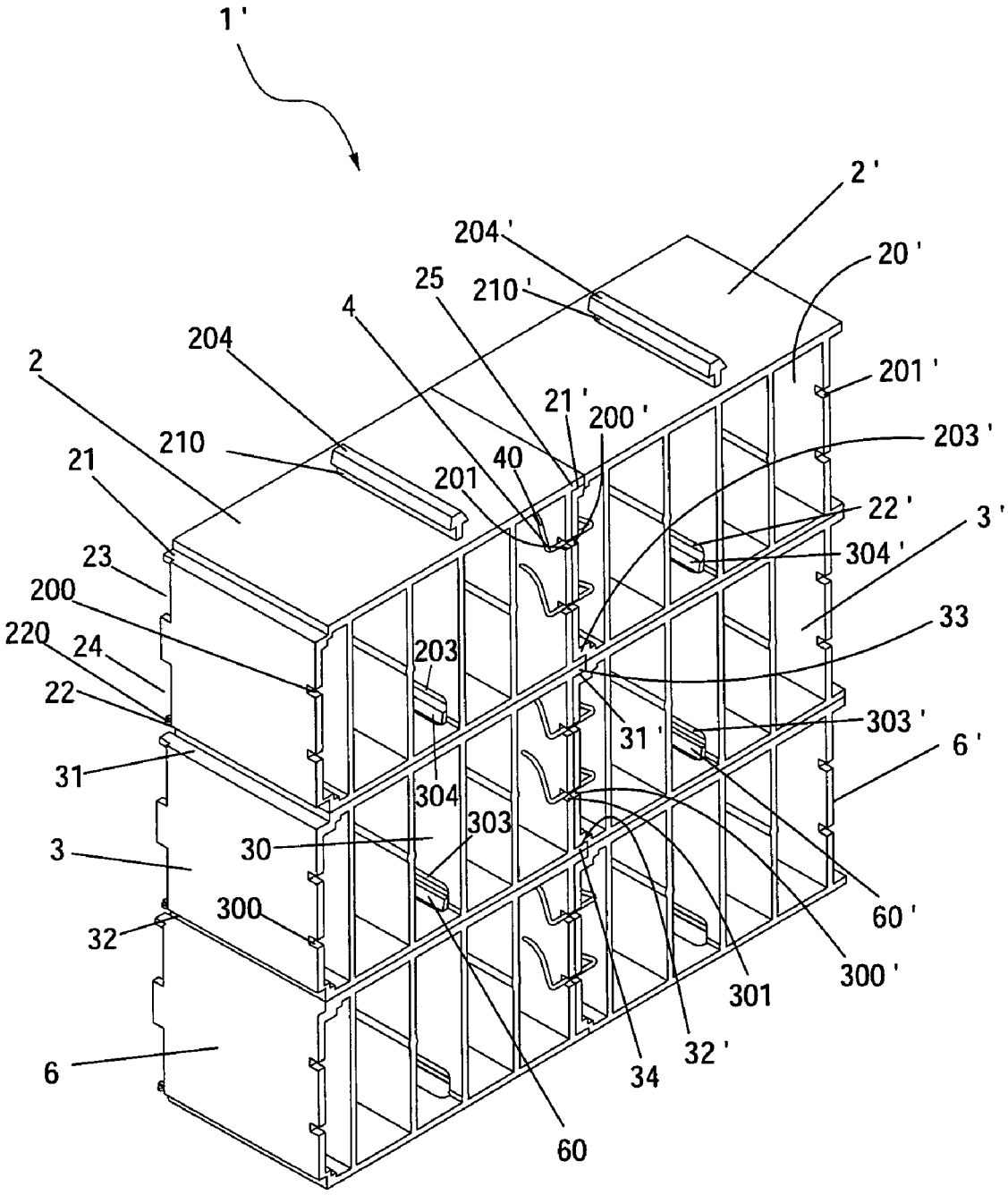
FIG. 7 is a perspective diagram of several sets of assembled upper and lower boards according to the present invention.

Further, refer to FIGS. 6 and 7 for the perspective diagram of the disassembled structure and the assembled structure of the groundwork frame with different number of layers according to another embodiment of the present invention. When the upper and lower boards 2, 2', 3, 3' are embedded with another board members 6, 6' by the protruded bars 60, 60', the protruded bar 60, 60' of another board member 6, 6' can be sheathed into the embedding groove 303, 303' at the bottom of the lower board 3, 3' to form a frame 1' with different number of layers and height depending on the actual height of the construction site (its assembling method is the same as the first embodiment, and thus will not be described here). The height of the frame 1' can be adjusted slightly on the uneven floor according to different landforms. The groundwork frame of this invention is easy-to-install, time-saving, labor-saving, and thus economically efficient and effective.

In summation of the description above, this invention discloses an improved groundwork frame structure to overcome the shortcomings of the prior-art groundwork construction, such as wasting the labor hours, being stuck with the screw connection, and aligning with the screw threads before the connection by screws can be made. Therefore, the frame of this invention provides an easy assembly, a simple application for the positioning on different sites, and a fine-tune adjustment for uneven floors.

While the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. An improved groundwork frame structure, comprising an upper board, a lower board, and an elastic clamp; wherein a protruded bar disposed in the middle of the top of said upper board and said lower board; an embedding groove disposed in the middle of the bottom of the groundwork frame and corresponding to said protruded bar; an upper groove and a lower groove respectively disposed on both sides of each floor board to define an embedded assembly; an opening disposed on each corresponding edge of adjacent boards; an elastic clamp for clipping and securing the groundwork frame, and each floor board having a chamber; a screw hole and an adjusting screw hole disposed on both sides of the chamber, such that the lower board on the floor being sheathed in the latch and an adjusting screw rod for adjusting the floor to an appropriate height.

2. The improved groundwork frame structure of claim 1, wherein said lower groove at its end has a blocking member.

3. The improved groundwork frame structure of claim 1, wherein said board has a corresponding opening at the position of an upper indent and a lower indent on each side of said board.

4. The improved groundwork frame structure of claim 1, wherein said lower protruded edge has a concave opening.

5. The improved groundwork frame structure of claim 1, wherein said board has a blocking panel protruded from the upper and lower section of the side of said board.

* * * * *